United States Patent [19]

Bell

[11] 4,183,439

[45] Jan. 15, 1980

[54] UTENSIL AND TOOL HOLDER

[76] Inventor: William W. Bell, R.P. Box 135, East Chatham, N.Y. 12060

[21] Appl. No.: 883,295

[22] Filed: Mar. 3, 1978

Related U.S. Application Data

[63] Continuation-in-part of Ser. No. 835,446, Sep. 21, 1977, abandoned.

[51] Int. Cl.[2] ..... A47F 7/00

[52] U.S. Cl. ..... 211/60 T; 211/DIG. 1; 248/206 A

[58] Field of Search ..... 211/60 T, 89, DIG. 1; 206/818; 335/283, 285, 296, 301-306; 223/109 A; 248/206 A, 37.3, 37.6, 467; 24/230 BC, 201 C

[56] References Cited

U.S. PATENT DOCUMENTS

| | | | |
|---|---|---|---|
| 361,248 | 4/1887 | Winton | 211/DIG. 1 |
| 2,389,298 | 11/1945 | Ellis | 211/DIG. 1 |
| 2,733,113 | 1/1956 | Humbarger | 211/DIG. 1 |
| 3,124,725 | 3/1964 | Leguillon | 223/109 A |
| 3,195,022 | 7/1965 | Staver | 248/206 A |
| 3,483,494 | 12/1969 | Cromie | 335/303 |
| 3,727,658 | 4/1973 | Eldridge, Jr. | 335/303 X |
| 3,875,623 | 4/1975 | Johnston | 24/230 BC X |

FOREIGN PATENT DOCUMENTS

| | | | |
|---|---|---|---|
| 708324 | 5/1954 | United Kingdom | 24/230 BC |
| 950273 | 2/1964 | United Kingdom | 335/303 |

*Primary Examiner*—Roy D. Frazier
*Assistant Examiner*—Robert W. Gibson, Jr.
*Attorney, Agent, or Firm*—Seymour Levine

[57] ABSTRACT

An apparatus for storing tools and utensils in a vertical position which utilizes flexible magnetic material made into strips with each strip freely hanging from an end coupled to a mounting means. To provide additional mounting strength each strip of flexible magnetic material is reinforced in the coupling region with a plastic tape.

2 Claims, 7 Drawing Figures

FIG. 4.
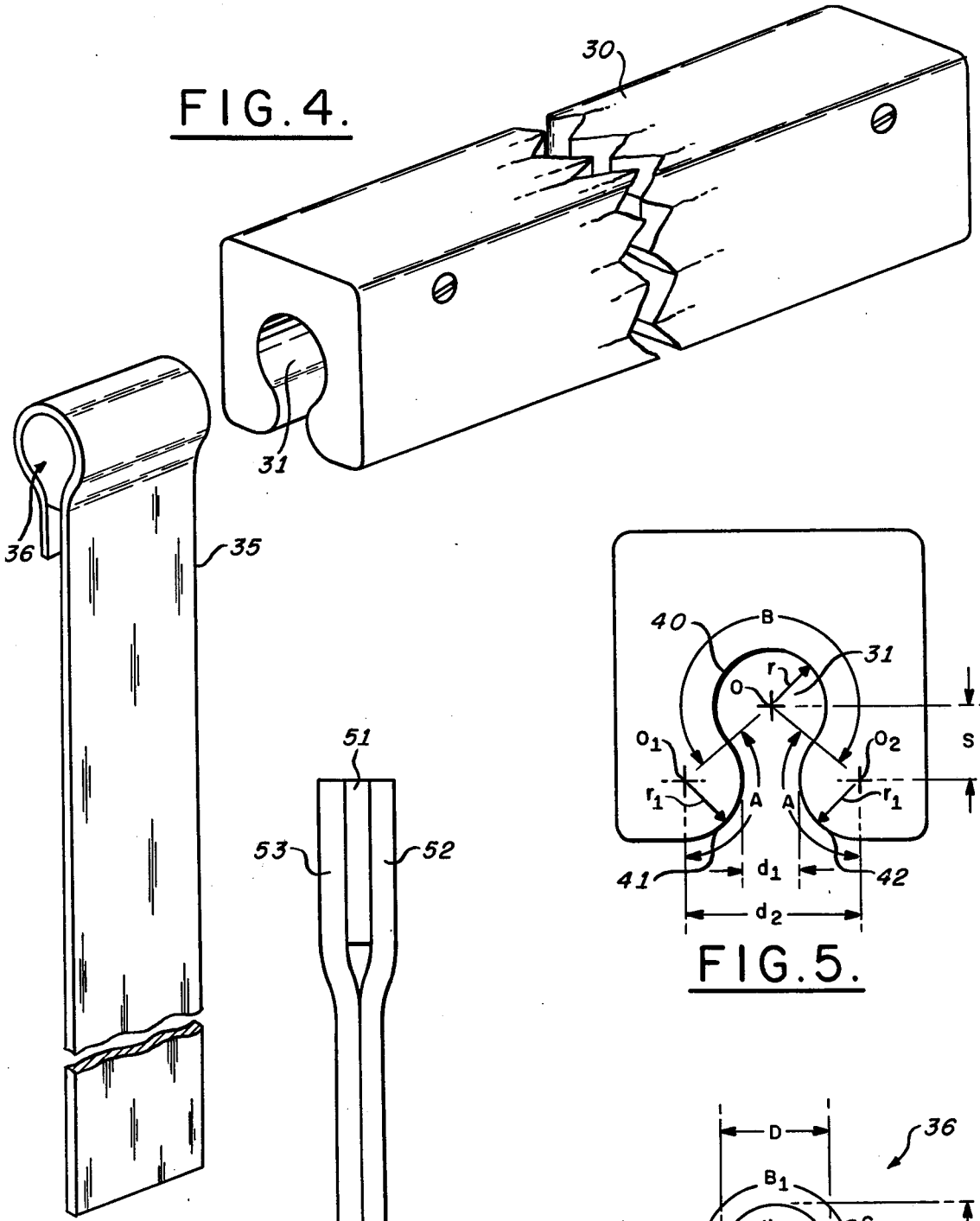
FIG. 5.
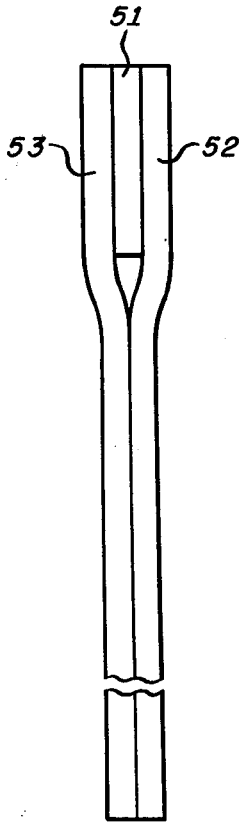
FIG. 7.
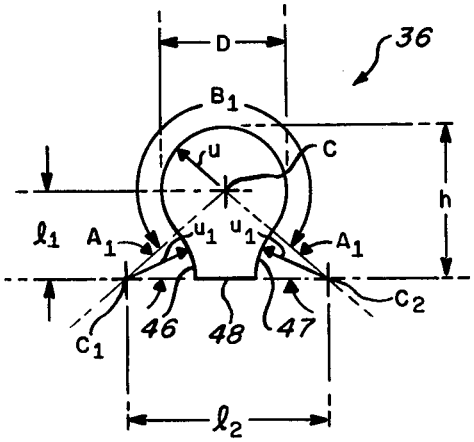
FIG. 6.

UTENSIL AND TOOL HOLDER

CROSS REFERENCE TO RELATED APPLICATIONS

This is a continuation-in-part of copending application Ser. No. 835,446 filed Sept. 21, 1977 now abandoned in the name of William W. Bell entitled Utensil and Tool Holder.

BACKGROUND OF THE INVENTION

1. Field of the Invention

The invention to devices for holding tools and kitchen utensils.

2. Description of the Prior Art

Utensil holders of the prior art have employed blocks of wood or plastic which contain slots for knife blades which are broadened to accomodate the knife handles. Each slot must be of the proper length and width to accomodate a given sized knife. Consequently slots of various lengths and handle widths must be provided, thus limiting the variety of knives that may be stored. Additionally, these lack versatility because they hold knives only and cannot be employed to store other utensils such as spatulas, spoons, and forks. Further the blades are hidden and the one wanted is selected by associating it with the appearance of the handle. This generally means a guess by the selector and may lead to the selection of a blade other than the one desired and another guess must then be made.

Other types of utensil holders provide depressions which follow the contours of the broad dimensions of the utensils to be stored. To insure retention of the utensils, when the holder is mounted in a vertical position, a retaining plate must be positioned over a portion of the holder. This retaining plate covers a major portion of the stored utensils, thus making it difficult to determine which blade is being selected when a handle is chosen.

Still another type of utensil holder of the prior art comprises a magnetic bar which holds the utensils by magnetic attraction. The attraction for each utensil is proportional to its width and may not be sufficient to hold relatively heavy utensils such as cleavers. Additionally, the magnetic bar does not provide definite positions and utensils may be scattered on the bar in a random fashion. This random positioning creates a situation by which the removal of one utensil may cause another to be unintentionally dislodged.

Another type of magnetic holder of the prior art comprises horseshoe magnetics or a multiplicity of rigid bar magnets arranged parallel to each other with alternate bar magnets being oppositely poled. Devices of this type require that the metallic article being held be positioned such that it crosses at least the oppositely poled bar magnetics. Utensils are also positioned on this device in a random manner and the removal of one may cause other utensils to be unintentionally dislodged.

Further, the section of an article held by rigid bar magnets which is in contact therewith, tend to abruptly separate therefrom where the handle or other exposed sections are accidently struck, thereby causing the article to drop from the rigid bar magnet holder. Another deficiency of a rigid bar magnet holder is that a strong magnetic field is required, usually restricted to a small area, to provide a holder capable of retaining tool and utensils thereon. When a tool or utensil is brought near the holder the strong magnetic field snaps the utensil forcibly to the hard magnet, possibly causing damage to the utensil or tool, such as by nicking a finely honed knife edge. This strong magnetic field also causes the tool or utensil to be tightly held, requiring an unduly strong mechanical force to remove articles from the holder.

What is needed is a utensil holder which can retain the heavier utensils and also provide open individual positions in which utensils may be readily mounted in an orderly fashion, without requiring strong concentrations of magnetic force which may damage the articles and make their removal difficult.

SUMMARY OF THE DISCLOSURE

The present invention discloses a holder of utensils comprised of strips of flexible magnetic material arranged in vertical parallel alignment. Each strip in the holder is capable of holding one utensil and a plurality of strips may be employed to hold larger and heavier utensils, such as cleavers. Utensils held are completely visible thus avoiding the possibility of erroneously selecting an unwanted utensil. The flexibility of the magnetic material allows for the removal of a utensil at a distance from the mounting position, thus eliminating mounting structure interference and facilitating utensil removal. When a knife is removed from a strip, a wiping motion is performed that provides a stropping action and a sharpening effect is realized.

BRIEF DESCRIPTION OF THE DRAWING

FIG. 4 is an illustration of the manner in which a strip assembly is mounted by means of a peg and groove.

FIG. 5 is a cross sectional view of a preferred form for a mounting peg.

FIG. 6 is a cross sectional view of a groove for accepting the peg illustrated in FIG. 5.

FIG. 7 is a side view of another strip assembly of the invention.

DESCRIPTION OF THE PREFERRED EMBODIMENT

Figure 2:
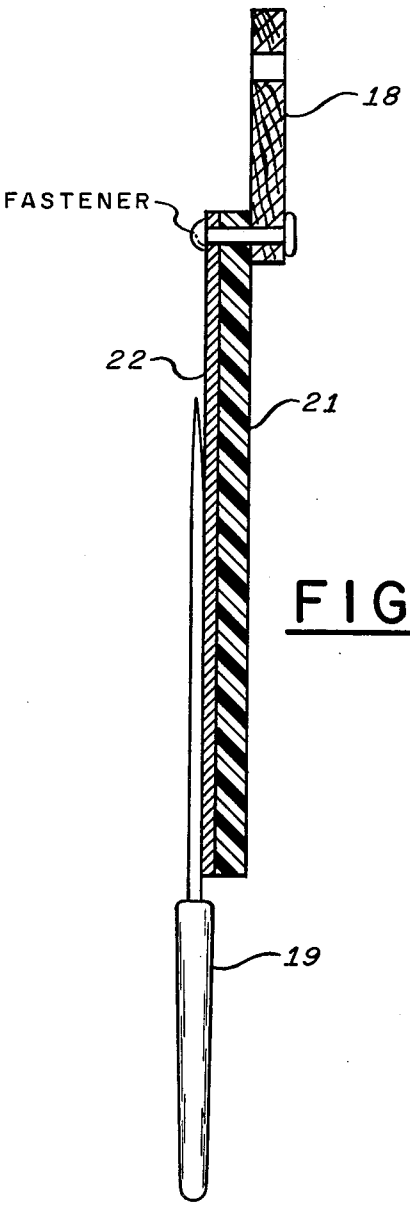
FIG. 2 is a side view of a single strip assembly of the invention.
Figure 1:
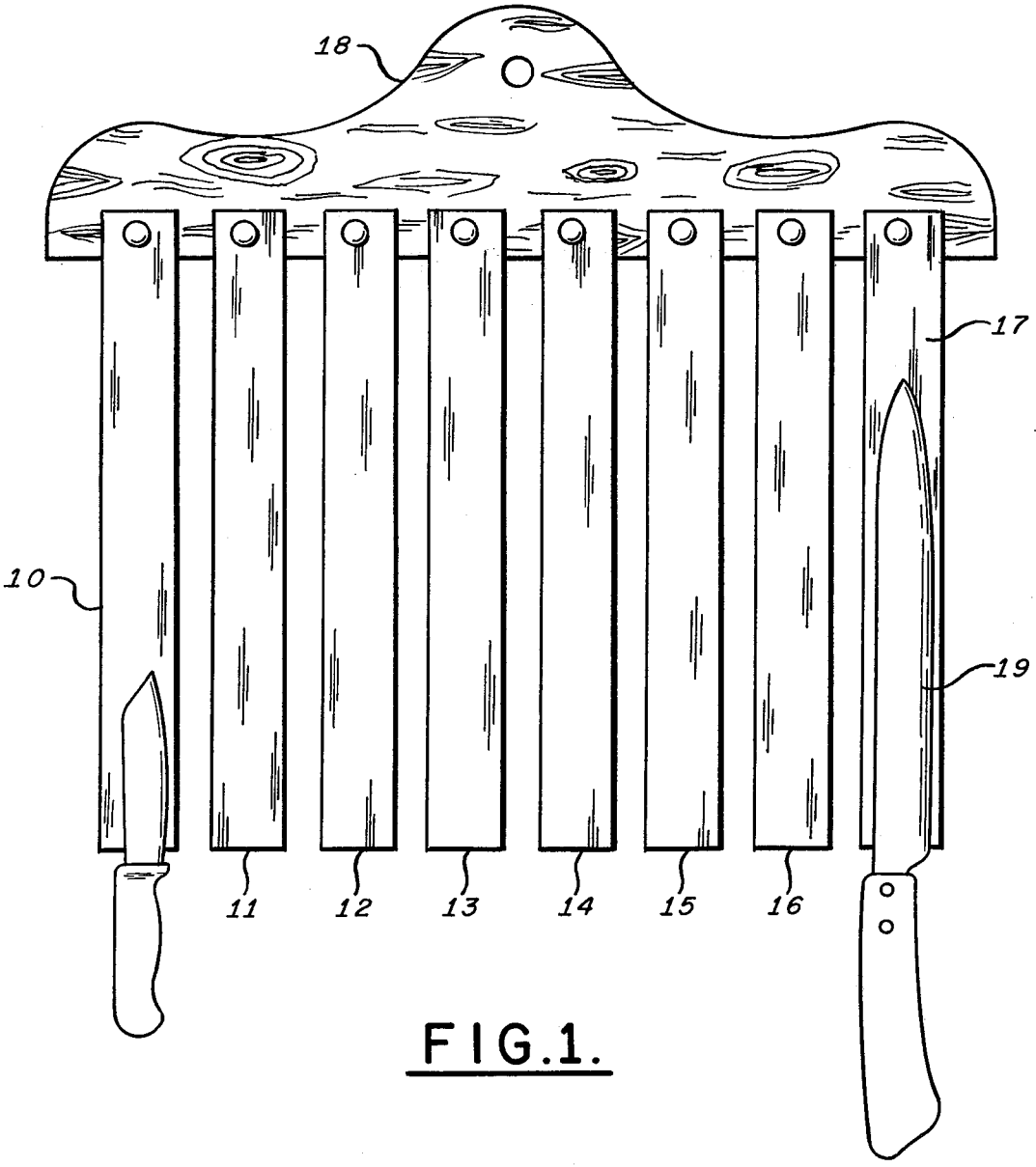
FIG. 1 is a front view of an embodiment of the invention.

Referring to FIG. 1, a utensil holder incorporating the principles of the present invention comprises one or more strips 10 through 17 which are made of a flexible magnetic material such as Allmag 60 made by Magna Visual Inc. and designated product number A1-6967. Each strip is of a width and length that is commensurate with the utensils to be held and of a thickness of at least 1/60 of an inch. To provide enhanced hanging characteristics the strips 10 through 17, represented as strip 21 in the side view shown in FIG. 2, may be provided with a backing 22 such as vinyl or some other appropriate material. Strips 10 thorough 17 may be nailed directly to a wall or mounted on a mounting bracket which may be made of wood, string, cloth, plastic, or another appropriate material. This configuration allows a knife 19 to be held in flush contact with a strip such as strip 17, thus minimizing the possibility of having a hand accidently coming in contact with the blade. When the knife 19 is removed from the strip 17 it does not come in contact with other objects causing the blade to become dull and a wiping action takes place that strops the blade to provide a sharpening effect. Though the FIG. 1 shows a knife 19 being held by strip 17, it should be apparent that other utensils such as spoons and forks, that are made of magnetic materials, may also be held by the strips 10 through 17.

The use of a single strip for each utensil provides a positive gripping action when inserting a utensil, makes each utensil that is held plainly visible, eliminates the possibility of accidently selecting an unwanted utensil, and allows for easy withdrawal without accidentally disturbing other utensils held on adjacent strips. Additionally, each unoccupied strip is available for the next utensil to be inserted, reducing the problem of finding space on a conventional magnetic bar holder on which utensils are scattered randomly.

Since the gripping action increases with the blade area in contact with the magnetic material strips 10 through 17, large utensils are held as firmly as small ones. Larger utensils such as cleavers may be held securely by using two or three adjoining strips. The holder will store other kitchen objects such as spatulas and bottle openers and such items as metal pencils. Further, such tools as chisels and end wrenches may be stored with many of the advantages stated for kitchen utensils.

Figure 3:
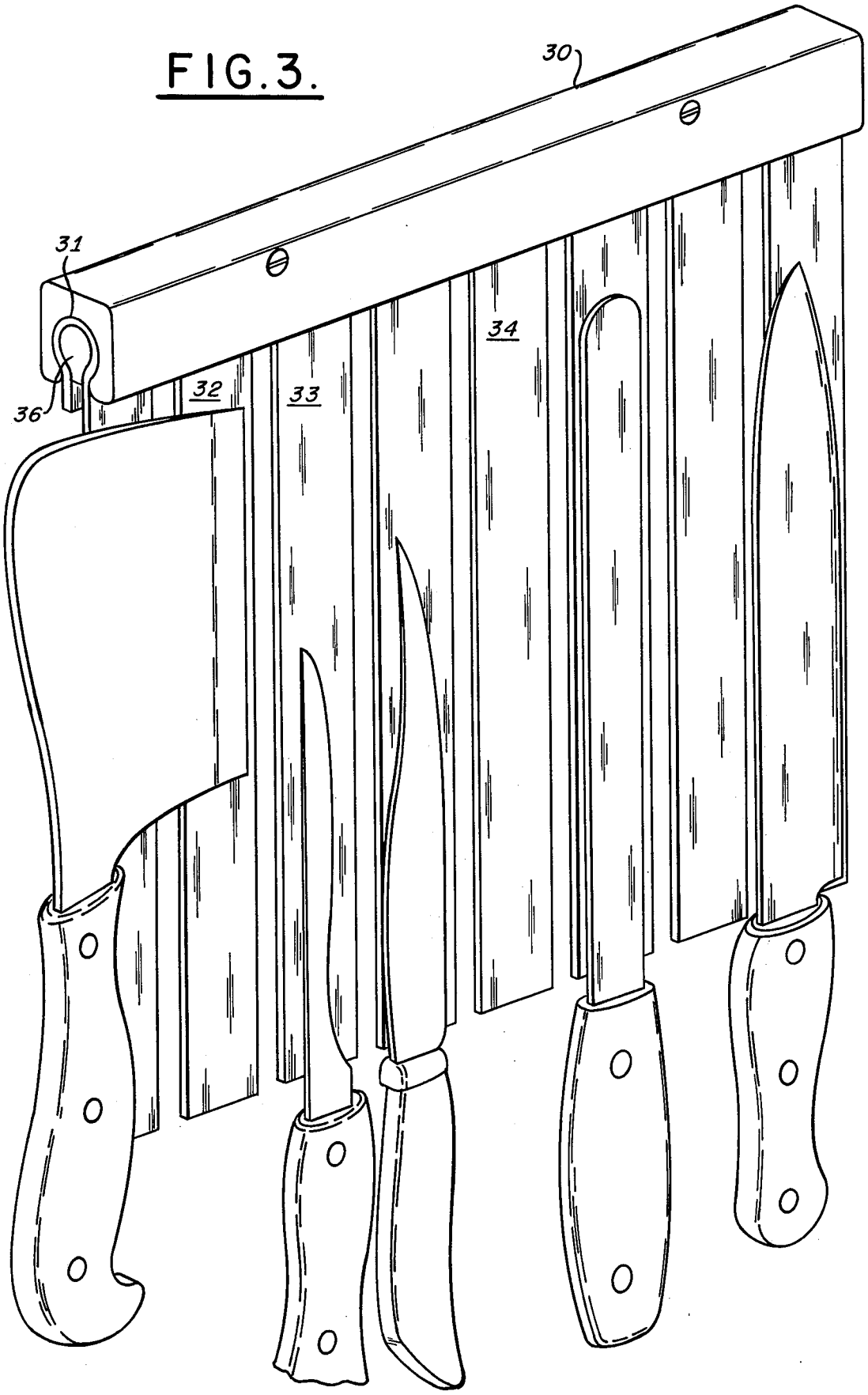
FIG. 3 is a front view of another embodiment of the invention.

In FIG. 3 is shown a utensil and tool holder in accordance with the present invention which utilizes a bracket 30, that contains a groove 31. Flexible magnetic strips such as 32, 33, and 34 are mounted from the bracket by wrapping portions of such magnetic strips around one or more pegs 36 suitably shaped and inserting the pegs so wrapped into the groove 31. The bracket 30 may be made of wood, plastic, or other rigid material. Insertion of the strip-wrapped peg into the groove 31 is illustrated in FIG. 4. Therein is shown a flexible magnetic strip 35 wrapped around a peg 36 prior to its insertion in the groove 31 of the bracket 30. The peg 36 may be of a length appropriate for mounting one strip, for mounting all strips to be mounted, or for mounting any number of strips therebetween. The groove 31 may be of a shape shown in FIG. 5. A first arc 40 with center O continues for an arc length of B degrees. At the terminations of arc 40 inflections occur and arcs 41 and 42, having centers at $O_1$ and $O_2$ respectively are caused to curve away from arc 40 for arc lengths of A degrees. The centers $O_1$ and $O_2$ are located a distance s vertically from the center O and are substantially equally spared horizontally about O with a spacing $d_2$ therebetween. The arcs 41 and 42 form a neck in the groove 31 that has as its narrowest dimension $d_1$. A configuration of the groove 31 may have arc A substantially equal to 128 degrees, arc B substantially equal to 283 degrees, s substantially equal to 0.27 inches (0.69 cm), $d_1$ substantially equal to 0.25 inches (0.64 cm), and $d_2$ substantially equal to 0.69 (1.75 cm) inches, and r and $r_1$ substantially equal to 0.22 inches (0.56 cm).

Radius r, of the groove 31 distributes bending forces over the length thereof, thus the flexible magnetic material is not subjected to bends that may cause it to crack when it is flexed during the positioning or the removal of an article. Radius r, also increases the service life of the flexible magnetic material by reducing the fatigue experienced thereby through repeated uses.

The cross section of a peg 36 suitable for insertion into the groove 31 of FIG. 5 is shown in FIG. 6. A head 45 extends an arc $B_1$ degrees about a center c with radius u. At the terminations of the head arc 45 inflections occur and arcs 46 and 47, having centers at $c_1$ and $c_2$ respectively, are caused to curve away from arc 45 for arc lengths of $A_1$ degrees. The centers $c_1$ and $c_2$ are vertically displaced from the center c a distance l, and are substantially equally spaced horizontally about c with a spacing $l_2$ therebetween, the entire peg being of a vertical height h. The base 48 though shown flat may be rounded with a suitable radius. A configuration for the peg 36 that matches the configuration of the groove given above may have $B_1$ substantially equal to 256 degrees, $A_1$ substantially equal to 38 degrees, u substantially equal to 0.16 inches (0.40 cm), $u_1$ substantially equal to 0.28 inches (0.71 cm), $l_1$ substantially equal to 0.27 inches (0.69 cm), $l_2$ substantially equal to 0.69 inches (1.75 cm), and h substantially equal to 0.43 inches (1.09 cm). The peg in its preferred form may be constructed of 50 durometer rubber, though wood or a suitable plastic may also be used.

A strip of flexible magnetic material suitable for wrapping about the peg 36 is shown in FIG. 7. A flexible plastic reinforcing tape 51 which may be 3 inches by 1 inch by 0.003 inches (7.62 cm×2.54 cm×0.008 cm) is positioned between two flexible magnetic strips 52 and 53 which may be 3 inches by 1 inch by 0.030 inches (7.62 cm×2.54 cm×0.08 cm). The flexible magnetic strips 52 and 53 may be joined to the plastic reinforcing tape 51 with double sided adhesive which extends for a suitable length therebetween. This double adhesive is not entirely necessary since the entire assembly may be held together by the magnetic attraction of the two flexible magnetic strips 52 and 53.

The use of two magnetic strips, as shown in FIG. 7, has many advantages over a single strip. Several of these advantages are: magnetic holding power is nearly doubled for the same contact area while maintaining flexibility that preserves easy article removal; lateral stiffness of the strips is increased, thus reducing the probability of adjacent strips in the assembly latching onto each other; and service life over that of a single strip is greatly extended.

While the invention has been described in its preferred embodiment, it is to be understood that the words which have been used are words of description rather than limitation, and that changes may be made within the purview of the appended claims without departing from the true scope and spirit of the invention in its broader aspects.

I claim:

1. A holder of magnetically attractable articles such as utensils and tools comprising:

at least one strip of flexible magnetic means for holding said utensils and tools, each of said flexible magnetic means including two flexible magnetic strips held together by magnetic attraction and including a reinforcing material therebetween, each of said two flexible magnetic strips having substantially equal lengths along a longitudinal axis and substantially equal widths and thickness, said lengths being of greater linear dimension than said widths, with said reinforcing material extending for a predetermined distance along said longitudinal axis from one end of said flexible magnetic means; and means for mounting said at least one strip of flexible magnetic means including a mounting bracket containing a groove therein, said groove being substantially horizontally positioned when said mounting means is properly mounted and peg means for mounting said at least one strip of flexible magnetic means on said mounting bracket by wrapping said one end thereof, from which said reinforcing material extends, about said peg means and inserting said peg means so wrapped into said groove such that each of said flexible magnetic means extends from said mounting means with said longitudinal axis substantially vertically positioned.

2. A holder of magnetically attractable articles such as utensils and tools in accordance with claim 1 wherein said peg means comprises at least one peg, each peg for mounting one strip of said at least one strip of flexible magnetic material.

* * * * *